US006912728B2

(12) United States Patent
Panella

(10) Patent No.: US 6,912,728 B2
(45) Date of Patent: Jul. 5, 2005

(54) HYGIENIC DEVICE AND METHOD FOR PARTICULAR USE IN GRASPING A DOORKNOB

(76) Inventor: Michael Joseph Panella, 8 Mill Pond Rd., Alexandria, NJ (US) 08848

( * ) Notice: Subject to any disclaimer, the term of this patent is extended or adjusted under 35 U.S.C. 154(b) by 102 days.

(21) Appl. No.: 10/295,486

(22) Filed: Nov. 15, 2002

(65) Prior Publication Data

US 2004/0020815 A1 Feb. 5, 2004

Related U.S. Application Data

(63) Continuation-in-part of application No. 10/208,637, filed on Jul. 30, 2002, now abandoned.

(51) Int. Cl.[7] ..... A41D 13/08
(52) U.S. Cl. ..... 2/16
(58) Field of Search ..... 2/16, 20, 21, 161.6, 2/163; 15/227

(56) References Cited

U.S. PATENT DOCUMENTS 2,621,784 A * 12/1952 Van Boytham ..... 206/361
2,695,999 A * 12/1954 Arnold ..... 2/20
2,925,605 A * 2/1960 Wheeler ..... 2/21
4,856,140 A * 8/1989 Visco et al. ..... 16/412
5,799,331 A * 9/1998 Stewart ..... 2/159
5,840,122 A * 11/1998 Williams ..... 118/505
5,975,083 A * 11/1999 Henderson, Jr. ..... 128/878
5,987,645 A * 11/1999 Teaster ..... 2/159
6,546,594 B1 * 4/2003 Wills ..... 16/422

* cited by examiner

*Primary Examiner*—Katherine M Moran
(74) *Attorney, Agent, or Firm*—Hoffmann & Baron, LLP

(57) ABSTRACT

The present invention is an apparatus and method for using a hygienic device to form a barrier between an object to be grasped, such as a doorknob, and a user's palm and fingers to prevent the transfer of unwanted bacteria and germs. The device is a covering for the palm and fingers of the user's hand which creates a barrier between the doorknob and the user's palm and fingers to prevent the transfer of germs thereto. The device is envisioned to have a pocket or other means to facilitate positioning of the hygienic device on the user's hand, with the pocket being of size to receive one or more fingers up to a depth of less than the middle knuckle. The method for using the hygienic device further includes providing a dispenser for holding multiple hygienic devices, a single device can be removed from the holder which is then placed upon the user's hand and is then used. After the hygienic device is used it can be disposed of as needed by the user.

9 Claims, 4 Drawing Sheets

40
Dispenser
42
44
46
48
50
52

HYGIENIC DEVICE AND METHOD FOR PARTICULAR USE IN GRASPING A DOORKNOB

CROSS-REFERENCE TO RELATED APPLICATIONS

This application is a continuation-in-part application of U.S. patent application Ser. No. 10/208,637, filed Jul. 30, 2002, now abandoned.

BACKGROUND OF THE INVENTION

The present invention relates generally to a germ or bacteria blocking device which can be easily manufactured and a method for using and disposing of after use, more specifically to a device which can be used on the surface of the palm and fingers of a person's hand to grasp a doorknob.

It is well known that germs and bacteria can be transmitted from one person's hand to an object such as a towel rack, soap dispenser, door latch, faucets, door knob and other fixtures or object and these germs can then be transmitted to a second user's hand when they touch the contaminated object, which was previously touched by an infected hand. Therefore, germs can pass from one person to another through the act of touching a contaminated object, such as a door handle or faucet.

Typically, objects and fixtures that can be contaminated with germs and bacteria are public restrooms. Although it is common knowledge that hand washing can prevent the transfer of such germs from being transferred to a bathroom fixture, such as a door knob upon leaving a bathroom, it is known that many individuals do not wash their hands and the germs encountered in a bathroom can be transferred from an unwashed hand to a doorknob leading out of the bathroom. Therefore, should a person touch the object after a person has not washed his hands, it is possible that bacteria could be transferred to this second person.

Since people have become aware of this problem and the possibility of picking up various germs and bacteria from door knobs or other fixtures, it has become a common practice to use either a paper towel or a tissue to grasp the door knob so that a barrier is created between the actual surface of the doorknob and the user's hand. A person may use a paper towel, a handkerchief or any other thin paper or cloth material to create a physical barrier between the surface of the contaminated item and the surface of their hand to prevent the possibility of germs passing to their hand.

However, the problem with this method is that a paper towel or a tissue may not sufficiently cover the user's hand and a part of the person's hand may contact the contaminated item and allow germs to be passed to the person's hand. In addition, in some restrooms there may be a hot air hand drier and a tissue or paper towel may not be available to use as a germ barrier.

It would be advantageous to have a hygienic device which would fit over a person's hand and provide a sufficient barrier between the person's palm surface and fingers and the object to be touched. It would also be advantageous to have a dispensing device and a method of using the hygienic device to prevent the transfer of germs from an object to a user's hand.

SUMMARY OF THE INVENTION

The present invention contemplates a hygienic device which is used to form a barrier against transfer of germs, bacteria and viruses from an object that needs to be grasped to a user's hand. The current design is an easy-to-use and disposable partial covering for the hand which allows a user to grasp and move various items while still protecting against possible transfer of germs from contaminated items. In one form, the hygienic device is only a partial covering of the hand, so that it is both easy to put on the user's hand and removed after it is used.

In a particular aspect of the invention, the hygienic device for protecting a user from germs comprises a first sheet having a predetermined length and a second sheet overlying the first sheet and being of length less than the first sheet. The second sheet defines with the first sheet a finger retention member of size for receiving one or more fingers of a hand of a user to an extent less than the distance from the distal end of such fingers to the middle knuckle thereof.

In accordance with a further aspect of the invention, a hygienic device for protecting a user from germs comprises a first sheet having a first surface for facing a hand of a user, the surface being of size and configuration to substantially cover the underside of at least several fingers of the hand. An adhesive is on the first surface for use by the user to retain the sheet on one or more fingers of the hand, the adhesive being removably adherent to the hand for temporarily holding the device on the hand for grasping an object with the device.

A method of hygienically protecting a user from germs on a doorknob is also envisioned in accordance with another aspect of the invention. Such method includes the steps of providing a hygienic device having a finger retention member and being of extent to at least cover the undersurface of fingers on the hand. After the device is retained on at least one finger of the hand, the user grasps a doorknob with the hand with the hygienic device disposed between the hand and the doorknob. The hygienic device is then separated from the at least one finger and suitably disposed.

As a result of the present invention, a cheap and effective barrier is provided for a user so that objects can be grasped in the user's hand and reduce the possibility of transferring any bacteria or viruses thereto.

It is an advantage of the present invention to provide a hygienic device which is easily positioned on the hand and easily removed after it is used, thus providing a quick and efficient barrier between the user's hand and possible contaminated objects or fixtures.

It is still a further advantage of the present invention to provide a dispenser and a method for using the hygienic device so that it can be located in areas which may contain contaminated objects so that the device can be accessed readily by a user.

For a better understanding of the present invention, together with other and further advantages, reference is made to the following detailed description, taken in connection with the accompanying drawings, and the scope of the invention will be pointed out in the appended claims.

DETAILED DESCRIPTION

Figure 1:
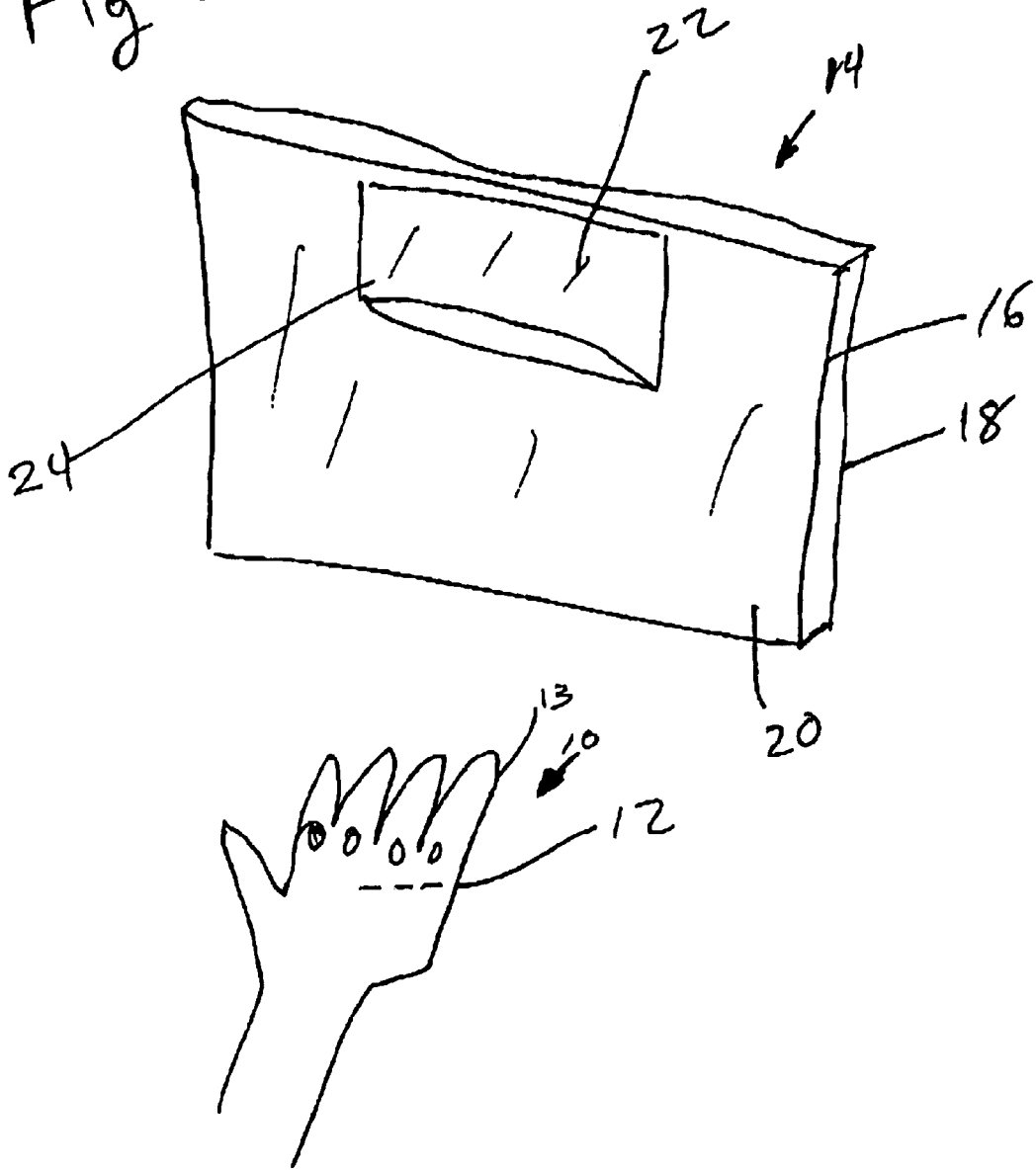
FIG. 1 is a top perspective view of a hygienic device of the present invention.

Referring to FIG. 1 a hygienic device 14 of the present invention is shown. The hygienic device 14 has a first sheet 16 which is sized to preferably cover the entire palm surface 12 and fingers of a person's hand 10 including the palm itself and the palm side 12 of a person's fingers. In a preferred embodiment, the first sheet 16 is sized to be larger than the person's hand 10 to allow for excess materials to extend over a person's hand 10. The hygienic device 14 is preferably made of a germ-blocking material which blocks both bacteria and/or virus from passing from an object through to the person's palm surface 12 of the hand. The first sheet 16 has an outerside 18 and an oppositely positioned palm side 20. On the palm side 20 there is a grasping means 22 which is used to facilitate the positioning of the hygienic device 14 on the person's hand 10 so that the palm surface 12 and the finger surfaces 13 are completely covered. As shown in FIG. 1 a pocket 24 is formed on the palm side 20 of the first sheet 16 so that a user's fingers can be inserted to hold the hygienic device 14 in a fixed position in relation to the person's hand 10.

Figure 2:
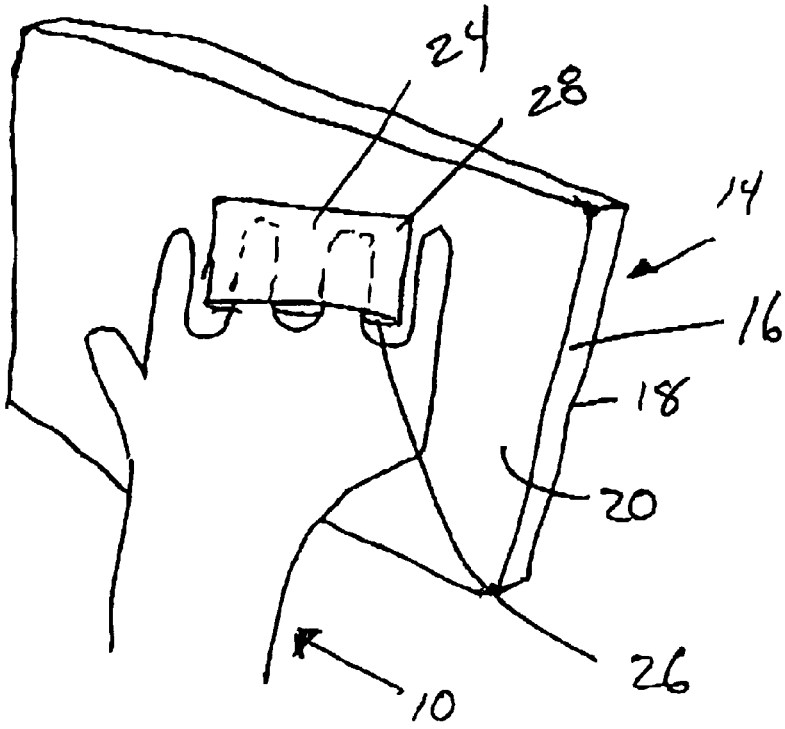
FIG. 2 is a top perspective view of a first embodiment of the hygienic device of the present invention with a hand being positioned.

As shown in FIG. 2 the pocket 24 is shown to allow two fingers to be inserted therein, preferably in a palm-down manner, so that the hygienic device 14 can be secured to a person's hand 10. It is envisioned that this pocket 24 is formed by attaching a separate second piece 28 of material to the palm side 20 of the hygienic device 14 and secured to form a pocket 24 with an opening 26 where at least one finger can be inserted.

Figure 3:
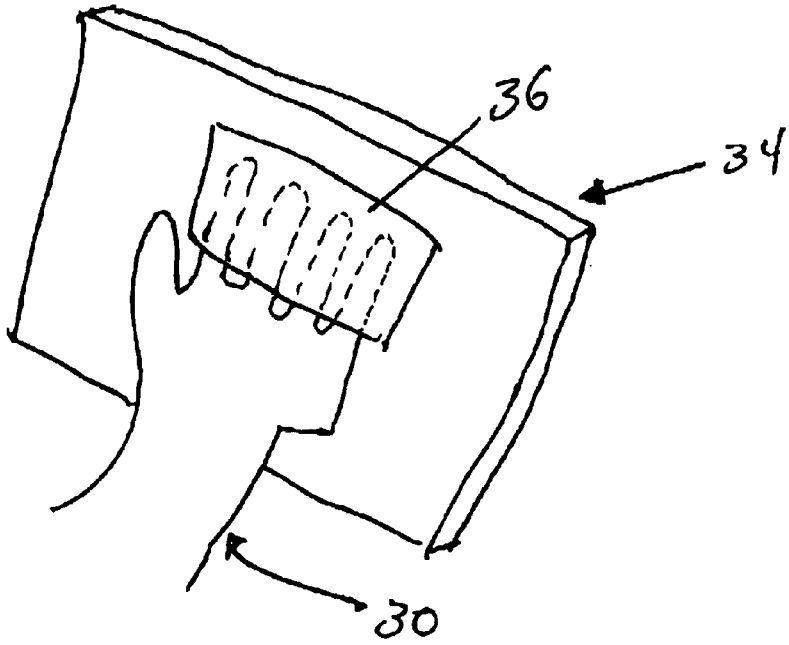
FIG. 3 is a top perspective view of an alternative embodiment of the hygienic device of the present invention with a hand being positioned.

In an alternative embodiment, it is envisioned that the pocket 36 is sized to allow for several fingers to be inserted into the pocket 36 so that a better grasping action is allowed to take place while the hygienic device 34 is placed on the person's hand. As shown in FIG. 3 the pocket 36 is sized to allow four fingers to be inserted, preferably in a palm-down manner, into the pocket 36 so that the hygienic device 34 is sufficiently positioned on the user's hand 30. As shown in FIGS. 1 through 3, it is shown how the hygienic device has a first sheet which can have a longitudinal axis which coincides with the longitudinal dimension of a person's hand extending from the wrist to the middle finger tip. The opening of the pocket can also be formed perpendicular to this axis so that when the person's hand lines up with the longitudinal axis of the hygienic device, the person's fingers are inserted into a pocket having an opening transverse the hygienic device's longitudinal axis.

In an alternative embodiment, a temporary adhesive can be applied to the palm side of the hygienic device to further facilitate the positioning of the hygienic device on a person's palm surface. This temporary adhesive is of a limited nature although it will allow the sheet a tacky feel, and can be used so that the hygienic device does not inadvertently fall off or be improperly positioned on the person's palm either before, during or after its usage.

Figure 4:
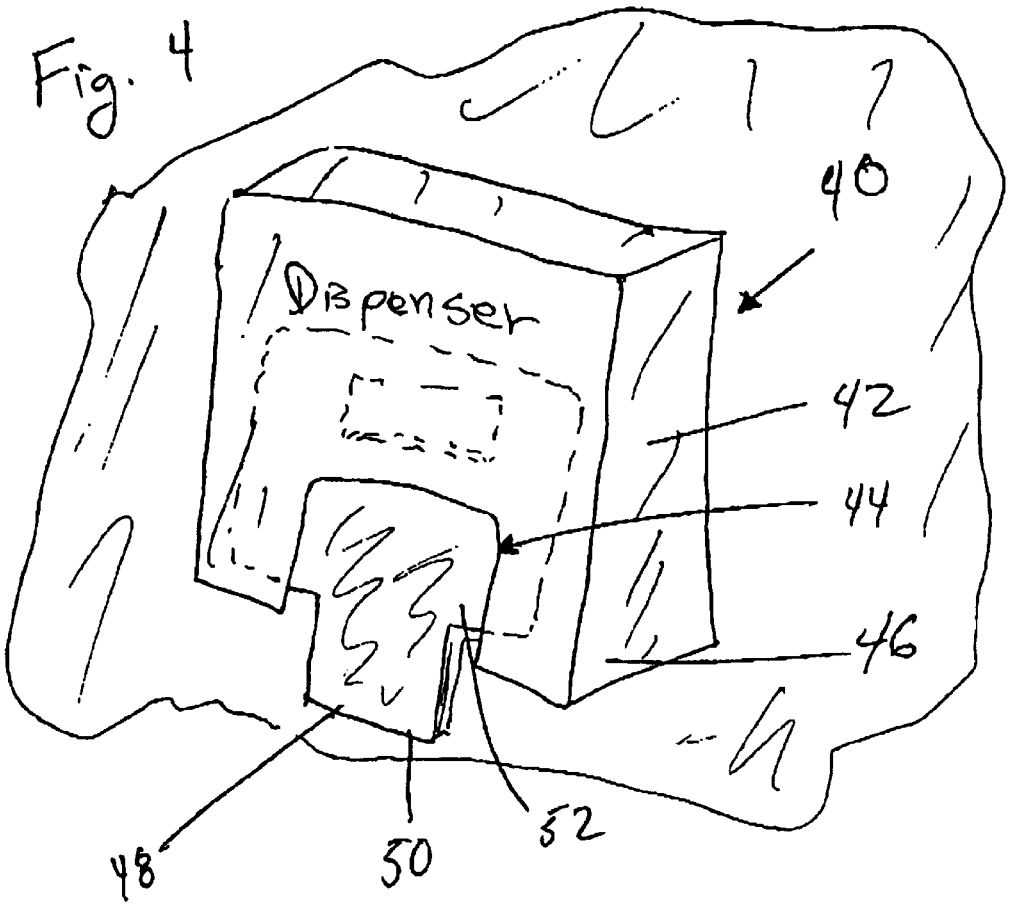
FIG. 4 is a top perspective view of a dispenser for the hygienic device of the present invention.

It is envisioned that the hygienic device can be dispensed from a holder so that multiple hygienic devices can be placed in an area such as a bathroom or lab where many different people may need to use the hygienic device. Referring to FIG. 4, a dispenser 40 containing hygienic devices 48 is shown having an outer housing 42 and an opening 44 therein to allow for removal of the hygienic devices 48. It is envisioned that the housing 42 can be made of a hard plastic, metallic material, or cardboard and positioned on a vertical surface such as a wall, or a horizontal surface such as a table, so it can be easily accessed by a user. The hygienic devices 48 can be placed within the dispenser 40 and stacked upon one another so that when one hygienic device 48 is removed, a second hygienic device 48 underneath is available so as to be removed by the user when needed. It is envisioned that the dispenser 40 has an interior compartment 46 and an access opening 44 to this compartment so that the hygienic devices 48 can be removed when needed. Also, a means to facilitate grasping each individual hygienic device to remove it from the holder can also be provided.

As shown in FIG. 4, the hygienic device 48 is provided with an extended tab 50 attached to and projecting from the first sheet 52 of a hygienic device 48 to facilitate grasping of one device 48 from the dispenser 40. It is envisioned that this tab 50 can be an extension or a part of the hygienic device 48 and can be integrally made with the hygienic device 48 to decrease costs of manufacture.

The use of the hygienic device will now be explained in conjunction with the dispenser. The hygienic device is first placed within the holder or dispenser. In a preferred embodiment, several hygienic devices are stacked within the holder so that several different people can use the devices if needed. The dispenser is then positioned on a horizontal or vertical surface within easy reach and viewing area of a potential person to use the device. It is envisioned that the dispenser is positioned in an area such as a public restroom, a laboratory, a hospital, a physician's office or dentist's office so that a user can easily grasp one of the hygienic devices when needed so as not to contact any contaminated items or fixtures which may be associated with any of these areas. It is preferable that the dispenser be positioned next to a towel dispenser or hand-drying device so that after a person's hands properly are cleaned, the person can then take one of the hygienic devices to prevent any further bacteria or viruses from contacting the person's hand upon touching any other objects in the room or upon leaving the room.

After the dispenser of the hygienic device containing the hygienic devices is properly positioned, a person can remove one of the hygienic devices from the holder and then place the hygienic device on the person's hand. As stated earlier, it is envisioned that a tab or extension can be used, or any other facilitating means, to help the user remove only one hygienic device from the holder at a time. The hygienic device is then placed on the user's hand and substantially covers the palm surface and fingers of the person's hand. After the hygienic device is properly positioned, the user can now grasp an object that may be contaminated by germs since the object is now separated from the user's palm and fingers by the hygienic device.

The objects which may be grasped by the user are such items such as doorknobs, faucets, toilet handles, toilet seats, soap dispensers and towel racks. All these items may be encountered in any of the areas previously mentioned such as restrooms, laboratories, hospitals and doctor's offices. These items may contain bacteria or germs and thus could be transferred to a user's hand if a hygienic device is not used. The hygienic device of the present invention creates a barrier between the contaminated item and the user's hand so that germs and bacteria cannot be transferred to the user.

After the person has finished using the hygienic device, the person can easily use the tab or grasp the hygienic device from the palm-side surface with the person's other hand and then dispose of the hygienic device in an appropriate manner.

Figure 6:
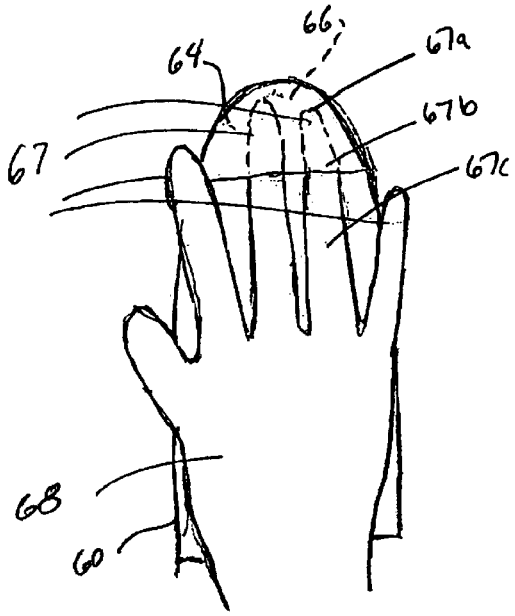
FIG. 6 is a plan view of the hygienic device of FIG. 5, showing the insertion of a user's fingers therein for subsequent use.
Figure 5:
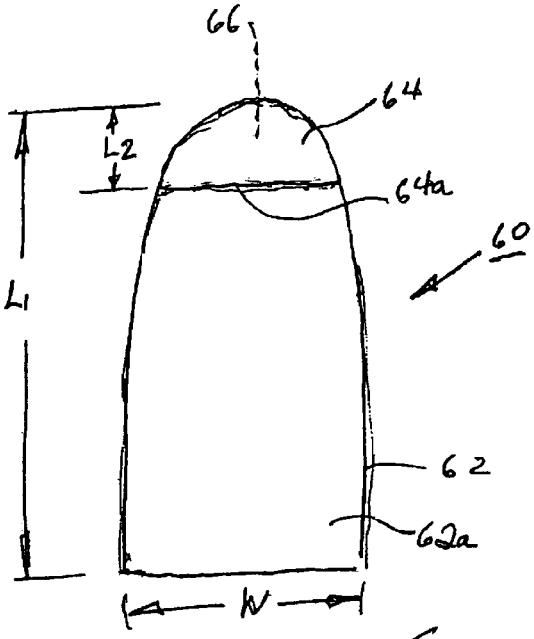
FIG. 5 is a plan view of a further variation of the hygienic device of the present invention for particular application for use in grasping doorknobs.
Figure 7:
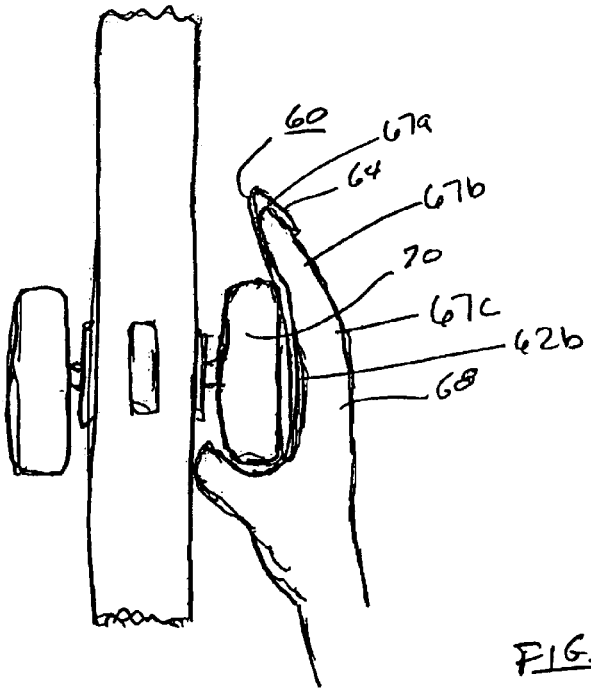
FIG. 7 is a side elevation view of the hygienic device of FIG. 5 showing use of the hygienic device for grasping a doorknob.

Referring now to FIGS. 5 through 7, a hygienic device 60 is described for particular, but not exclusive, use for grasping a doorknob in a hygienic manner. Hygienic device 60 may be a variation of the hygienic device 14 shown and described with reference to FIG. 2 hereinabove, but is configured and sized to be particularly useful for grasping doorknobs.

Hygienic device 60, as illustrated in FIG. 5, has a first longer sheet 62 of length $L_1$, and a second shorter sheet 64 of length $L_2$ attached to sheet 62 at one end thereof. Sheet 64 may be attached to sheet to Sheet 62, by any appropriate means substantially along the outer edges of the sheets 62 and 64, but not along transverse edge 64*a*, thereby defining an open pocket 66 between sheets 62 and 64. The outer edges of sheets 62 and 64 where joined may be curved as depicted, although such edges may be linear defining a rectangular shape or other desired shape. It should be understood that sheet 64 may be attached to sheet 62 at locations other than the peripheral edges to thereby define the pocket as a loop, band or other finger retention opening. It should also be understood that sheet 64 may be a portion of longer sheet 62, folded over onto itself to define pocket 66.

The length $L_1$, of sheet 62 is particularly sized to be about the length of an average human hand from the tip of the middle finger to the base of the palm. The width W of sheet 62 is particularly sized to be about the width of an average hand. The length of $L_2$ of sheet 64 is preferably sized to form pocket 66 of depth to receive the middle and ring fingers of an average hand 68 up to about the middle knuckle 67*c*. More preferably, the pocket 66 is sized as shown in FIG. 6 to receive the middle and ring fingers up to about the first knuckle 67*b* from the distal end 67*a* of the fingers 67. Receiving these two fingers in such a fashion will allow for ease of finger insertion, particularly when hygienic devices 60 are mounted vertically on a wall in a suitable dispenser adjacent to a doorknob to be grasped. In accordance with one particular example of the hygienic device 60, $L_1$ is approximately 7.0 inches, $L_2$ is approximately 2.0 inches and W is approximately 3.5 inches. It should be appreciated that while other suitable dimensions may be used for device 60 the length of $L_2$ of sheet 64 is preferably less than about half the length $L_1$ of sheet 62 and is more preferably about one quarter of the length $L_1$ of sheet 62, or less. While pocket 66 is formed to particularly receive two fingers of an average hand, such pocket may be also formed to receive any number of fingers provided that ease of finger insertion is facilitated by a relatively short depth of pocket 66 as described herein.

It should also be understood that a temporary adhesive 62*b* as described hereinabove can be applied to hygienic device 60 to further facilitate retention of the device 60 on the fingers of a person's hand. Such adhesive 62*b* may be applied on a portion of the palm side 62*a* of the sheet 62, preferably adjacent the pocket 66, and may be extended into the pocket 66. It should also be appreciated that the hygienic device 60 may be made of a germ blocking material or contain such a germ blocking or killing substance, such as alcohol or other desirable substance.

By reference now to FIG. 7, the application of the device 60 for grasping a doorknob 70 is described. Upon sliding fingers into the pocket 66 of the hygienic device 60 to retain the device on the hand, and removal of an individual device from a suitable dispenser where provided, the hygienic device 60, which substantially covers the entire underside of the fingers and palm of the hand, is placed over the doorknob 70 for grasping. The device 60 substantially covers the doorknob 70 and thereby serves as a barrier between the doorknob 70 and the hand 68. As such, after a user's hands are appropriately washed, for example, in a lavatory or the like, the device 60 may be used to prevent germs that may be disposed on the doorknob from being transferred to the user's hand, thereby promoting an improved hygienic condition. The hygienic device 60 may then be simply separated from the hand and disposed in a suitable trash container.

The advantage of using the hygienic device is that since it is a simple device, it can be provided in the dispenser as previously mentioned in a variety of environments. The hygienic device is preferably made so that it is disposable so as not to be inadvertently used a second time to possibly transfer germs on the outer surface of the hygienic device to another person or object.

A further advantage of the present invention is that the hygienic device does not fully cover the outer surface of the user's hand and is easily positioned on the user's palm and fingers and does not require extensive time or effort to be properly used.

Therefore, while there have been described as what are presently believed to be preferred embodiments of the present invention, those skilled in the art will realize that other and further changes and modifications can be made thereto without departing from the scope of the invention, and it is intended to claim all such changes and modifications that fall within the scope of the invention.

What is claimed is:

1. A method of hygienically protecting a user from germs on a doorknob comprising the steps of:

providing a hygienic device including a first portion being a finger retention member for enclosing between two to four fingers therein, and a second portion having a planar surface extending from said first portion, said planar surface having a finger portion and a palm portion, said finger portion covering a portion of an undersurface of said fingers, said palm portion covering an undersurface of a palm of a hand, said palm portion including a temporary adhesive;

retaining said finger retention member on between two to four fingers of said hand, a thumb finger remaining uncovered by said device, wherein said retaining comprises sliding said fingers into said finger retention member to a depth less than the length of such fingers from its distal end to the middle knuckles thereof;

adhering said palm of said hand to said adhesive;

grasping said doorknob with said hand with said hygienic device disposed between said hand and said doorknob;

separating said hygienic device from said fingers; and disposing said hygienic device.

2. A method according to claim 1 wherein said providing step comprises providing a finger retention member in the form of a pocket on said hygienic device for slidably receiving said fingers therein.

3. A hygienic device for protecting a user from germs comprising:

a first sheet having a predetermined length to cover an undersurface of fingers and palm of a hand;

a second sheet overlying said first sheet and being of length less than said first sheet and defining with said first sheet a finger retention member, said finger retention member including one opening of size for receiving two or more fingers of said hand of a user and of a size for receiving two or more fingers of said hand to an extent less than the distance from the distal end of such fingers to the middle knuckle thereof, wherein a thumb finger, a back of said hand and wrist remains uncovered and free from said finger retention member; and an adhesive on a surface of said first sheet facing said one or more fingers for temporarily adhering said first sheet to said one or more fingers.

4. A hygienic device according to claim 3, wherein said finger retention member comprises one pocket having a single opening for receiving said two or more fingers.

5. A hygienic device according to claim 4, wherein the depth of said pocket is less than half the predetermined length of said first sheet.

6. A hygienic device according to claim 4, wherein the depth of said pocket is approximately two inches.

7. A hygienic device according to claim 5, wherein said predetermined length is about the length of a hand from the distal end of the middle finger to the base of the palm of said hand.

8. A hygienic device according to claim 7, wherein said first sheet is of width about the width of a hand.

9. In combination, a pluraity of hygienic devices according to claim 3 and a dispenser containing such devices for individual removal therefrom.

* * * * *

UNITED STATES PATENT AND TRADEMARK OFFICE

CERTIFICATE OF CORRECTION

PATENT NO. : 6,912,728 B2
DATED : July 5, 2005
INVENTOR(S) : Michael Jospeh Panella It is certified that error appears in the above-identified patent and that said Letters Patent is hereby corrected as shown below:

Column 8,
Line 26, reads "...a pluraity of hygienic devices"; and should read -- a plurality of hygienic devices --.

Signed and Sealed this

Thirtieth Day of August, 2005

JON W. DUDAS
*Director of the United States Patent and Trademark Office*